US008607389B1

(12) United States Patent
Kunde

(10) Patent No.: US 8,607,389 B1
(45) Date of Patent: Dec. 17, 2013

(54) BED FRAME ATTACHABLE TRANSFER BAR

(71) Applicant: Michael F. Kunde, Oconomowoc, WI (US)

(72) Inventor: Michael F. Kunde, Oconomowoc, WI (US)

( * ) Notice: Subject to any disclaimer, the term of this patent is extended or adjusted under 35 U.S.C. 154(b) by 0 days.

(21) Appl. No.: 13/676,965

(22) Filed: Nov. 14, 2012

(51) Int. Cl.
*A47C 21/00* (2006.01)

(52) U.S. Cl.
USPC ..... 5/662; 5/424; 5/428

(58) Field of Classification Search
USPC ..... 5/662, 424, 428–430
See application file for complete search history.

(56) References Cited

U.S. PATENT DOCUMENTS 3,021,534 A 2/1962 Hausted
3,863,282 A * 2/1975 Stillwell ..... 5/503.1
5,384,927 A * 1/1995 Mardero et al. ..... 5/662
6,012,182 A * 1/2000 Allen et al. ..... 5/81.1 R
6,039,293 A * 3/2000 Minet ..... 248/125.8
6,728,985 B2 5/2004 Brooke et al.
6,986,177 B2 * 1/2006 Thaxton ..... 5/81.1 R
7,467,434 B1 * 12/2008 Kunde et al. ..... 5/662
7,568,249 B1 8/2009 Kunde et al.

* cited by examiner

*Primary Examiner* — Peter M Cuomo
*Assistant Examiner* — Brittany Wilson
(74) *Attorney, Agent, or Firm* — Donald J. Ersler

(57) ABSTRACT

A bed frame attachable transfer bar preferably includes a rail attachment member, a lengthwise member, an adjustment member, a second rail attachment member, a second lengthwise member and at least one transfer bar. The first and second rail attachment members include a rail bracket, a lengthwise member receiver and a transfer bar receiver. A deck portion of a bed frame is retained by the first and second rail brackets. The lengthwise members are retained by the lengthwise member receivers. One end of the adjustment bar is retained by the other end of the lengthwise member with a first fastener. The other end of the adjustment bar is retained by the second lengthwise member with a second fastener. Each transfer bar preferably includes a hand ring and a support post. The support post is received by a single transfer bar receiver.

19 Claims, 5 Drawing Sheets

BED FRAME ATTACHABLE TRANSFER BAR

BACKGROUND OF THE INVENTION

1. Field of the Invention

The present invention relates generally to devices for providing assistance for getting in and out of a bed, and more specifically to a bed frame attachable transfer bar, which reduces the risk of injury or death from entrapment.

2. Discussion of the Prior Art

There are numerous transfer bars in the art that aid in getting infirm, disabled and elderly people in and out of bed. A poorly designed transfer device can result in the injury and death to people trying to get out of a bed. U.S. Pat. No. 3,021,534 to Hausted discloses adjustable bed rails. U.S. Pat. No. 6,728,985 to Brooke et al. discloses an ambulatory assist arm apparatus. U.S. Pat. No. 7,467,434 to Kunde et al. discloses a bed frame attachable transfer bar device. U.S. Pat. No. 7,568,249 to Kunde et al. discloses a bed frame attachable transfer bar device.

Accordingly, there is a clearly felt need in the art for a bed frame attachable transfer bar, which may be removably attached to any single occupant bed and which reduces the risk of injury or death from entrapment.

SUMMARY OF THE INVENTION

The present invention provides a bed frame attachable transfer bar, which may be removably attached to any single occupant bed. The bed frame attachable transfer bar (transfer bar device) preferably includes a rail attachment member, a lengthwise member, an adjustment member, a second rail attachment member, a second lengthwise member and at least one transfer bar. The rail attachment member includes a rail bracket, a lengthwise member receiver and a transfer bar receiver. The rail bracket is preferably a U-channel. An open end of the rail bracket is sized to receive an outer perimeter of a deck portion of a bed frame. The lengthwise member receiver is attached to a bottom of the rail bracket. One end of the lengthwise member is sized to be received by an inner perimeter of the lengthwise member receiver. The transfer bar receiver is attached to a closed end of the rail bracket.

The second rail attachment member preferably includes a second rail bracket, a second lengthwise member receiver and a second transfer bar receiver. The second rail bracket is preferably a U-channel. An open end of the second rail bracket is sized to receive an outer perimeter of a deck portion of a bed frame. The second lengthwise member receiver is attached to a bottom of the second rail bracket. One end of the second lengthwise member is sized to be received by an inner perimeter of the second lengthwise member receiver. The second transfer bar receiver is attached to a closed end of the rail bracket. The adjustment member includes a plurality of holes formed through a length thereof. One end of the adjustment bar is inserted into the other end of the lengthwise member and secured with a first width fastener. The other end of the adjustment bar is inserted into the other end of the second lengthwise member and secured with a second width fastener.

Each transfer bar preferably includes a hand ring and a support post extending downward from the hand ring. The support post is sized to be received by one of the transfer bar receivers. At least one spring pin extends from the support post. A retention hole and an exit hole are formed through the transfer bar receiver to receive the at least one spring pin. The retention hole orients the hand ring, such that the hand ring is parallel with a side of the bed. The exit hole orients the hand ring, such that the hand ring is substantially perpendicular to the side of the bed. The second transfer bar receiver retains a second transfer bar.

Accordingly, it is an object of the present invention to provide a transfer bar device, which may be removably attached to any single occupant bed.

Finally, it is another object of the present invention to provide a transfer bar device, which reduces the risk of injury or death from entrapment.

These and additional objects, advantages, features and benefits of the present invention will become apparent from the following specification.

DETAILED DESCRIPTION OF THE PREFERRED EMBODIMENTS

Figure 1:
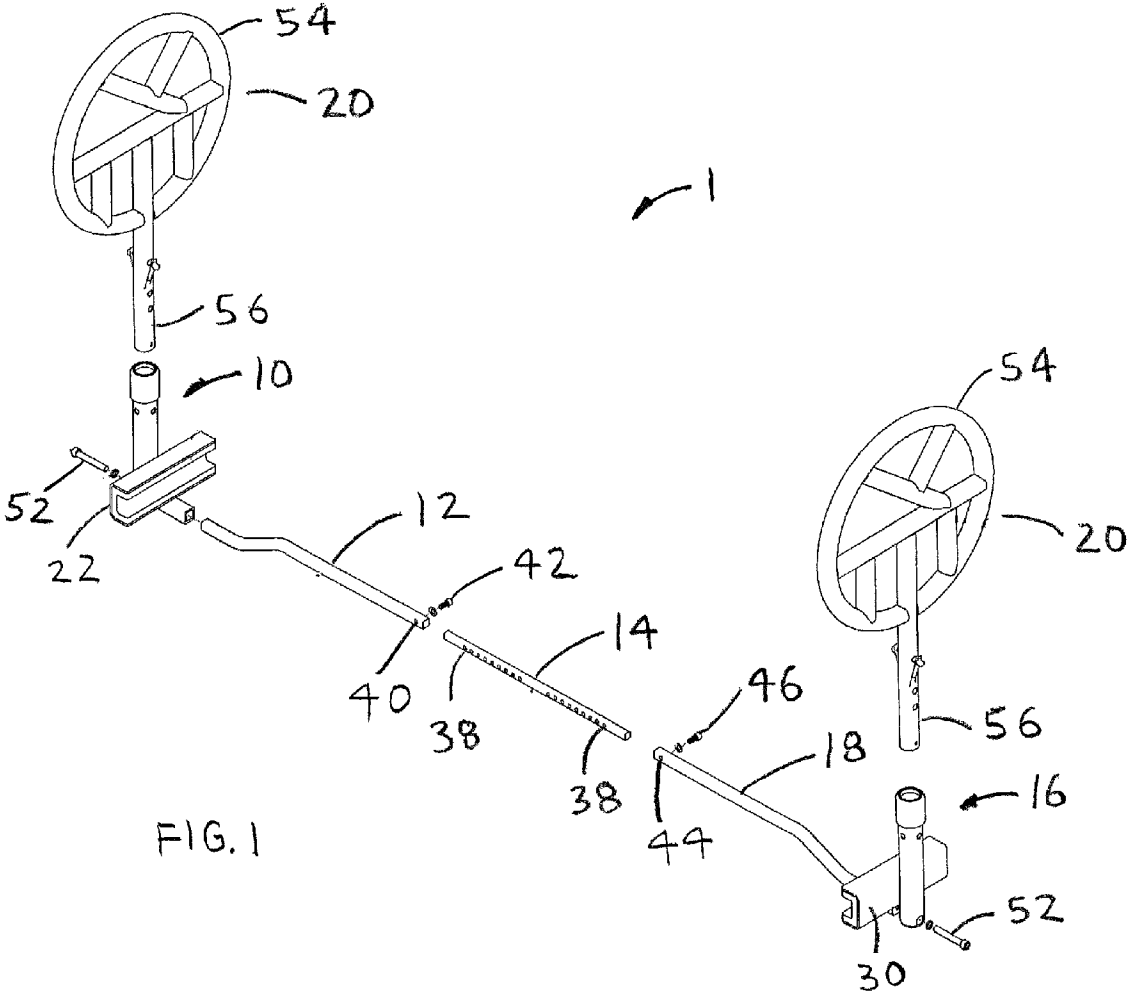
FIG. 1 is an exploded perspective view of a transfer bar device in accordance with the present invention.
Figure 2A:
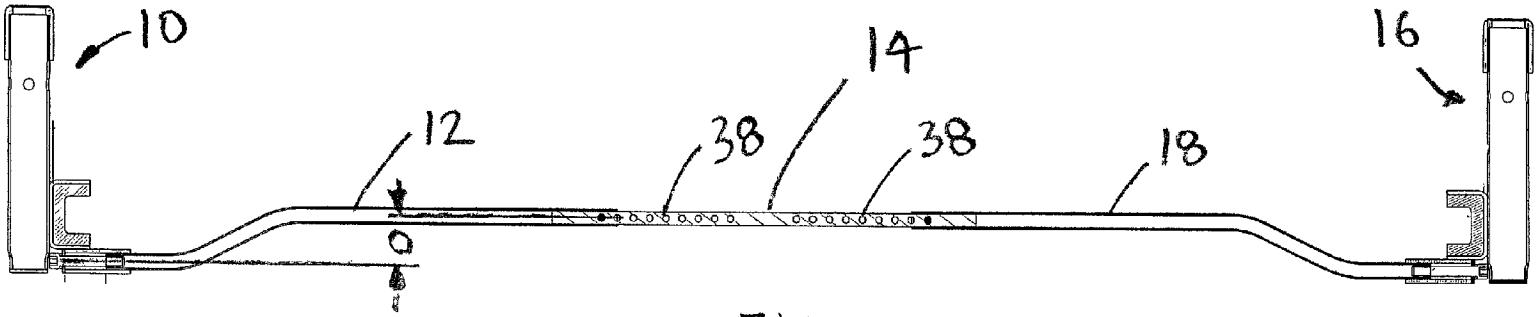
FIG. 2*a* is an end view of a transfer bar device in a fully extended position in accordance with the present invention.
Figure 2B:
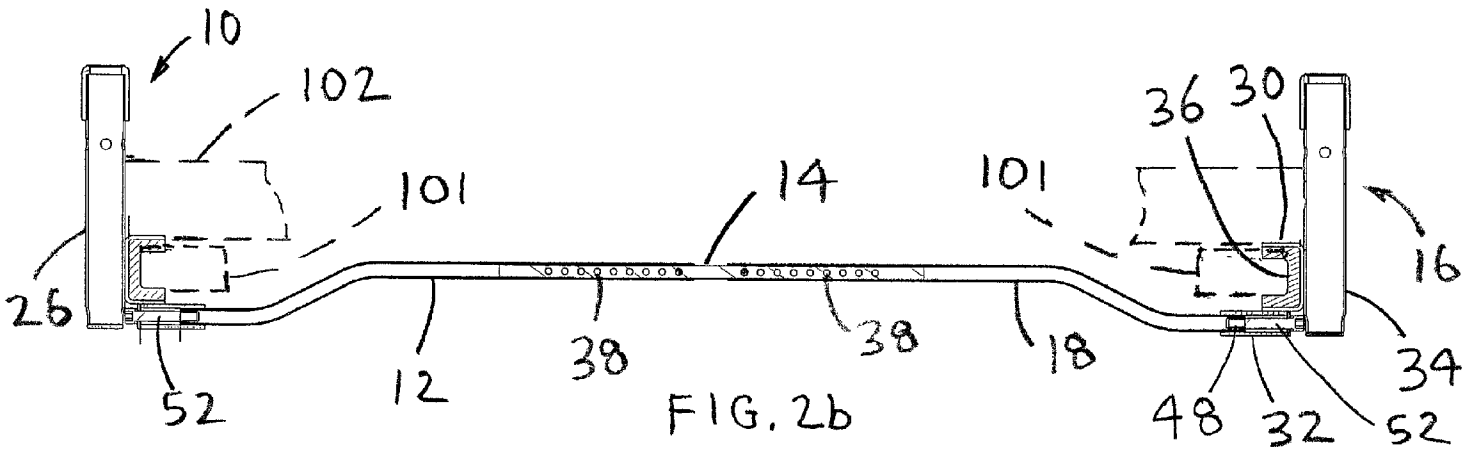
FIG. 2*b* is an end view of a transfer bar device in a fully retracted position retaining a deck portion of a bed frame and a mattress in accordance with the present invention.
Figure 3:
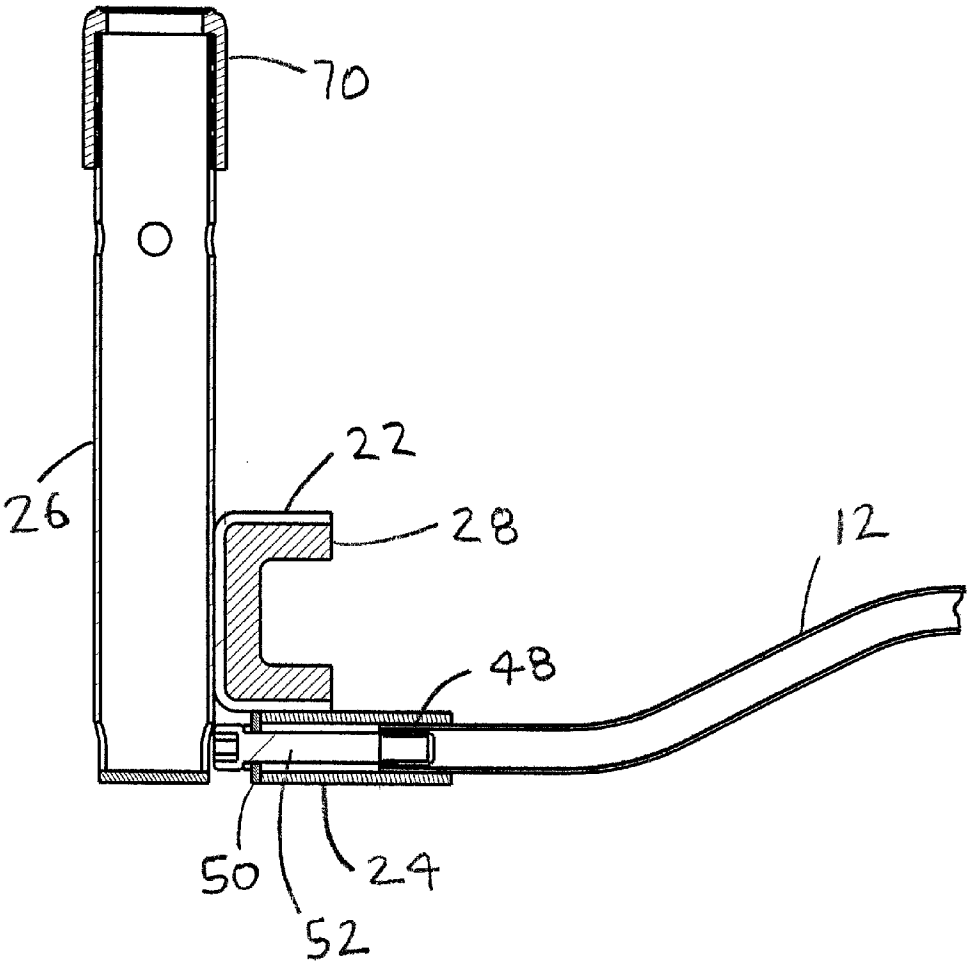
FIG. 3 is an enlarged cross sectional view of a rail attachment member of a transfer bar device in accordance with the present invention.

With reference now to the drawings, and particularly to FIG. 1, there is shown an exploded perspective view of a transfer bar device 1. With reference to FIGS. 2-3, the transfer bar device 1 preferably includes a rail attachment member 10, a lengthwise member 12, an adjustment member 14, a second rail attachment member 16, a second lengthwise member 18 and at least one transfer bar 20. The rail attachment member 10 includes a rail bracket 22, a lengthwise member receiver 24 and a transfer bar receiver 26. The rail bracket 22 is preferably a U-channel. A resilient spacer 28 is preferably attached to an inside surface of the rail bracket 22. The resilient spacer 28 is preferably fabricated from a rubber material, but other materials may also be used. The resilient spacer 28 will receive an outer perimeter of a deck portion 101 of a bed frame 100. The resilient spacer 28 will not mar the outer surface of the deck portion 101. The lengthwise member receiver 24 is attached to a bottom of the rail bracket 22 with welding or any other suitable method. One end of the lengthwise member 12 is sized to be received by an inner perimeter of the lengthwise member receiver 24. The transfer bar receiver 26 is attached to a closed end of the rail bracket 22 with welding or any other suitable method.

The second rail attachment member 16 preferably includes a second rail bracket 30, a second lengthwise member receiver 32 and a second transfer bar receiver 34. The second rail bracket 30 is preferably a U-channel. A second resilient spacer 36 is preferably attached to an inside surface of the rail bracket 30. The second resilient spacer 36 is preferably fabricated from a rubber material, but other materials may also be used. The second resilient spacer 36 will receive an outer perimeter of the deck portion 101 of the bed frame 100. The second resilient spacer 28 will not mar the outer surface of the deck portion 101. The second lengthwise member receiver 32 is attached to a bottom of the second rail bracket 30. One end of the second lengthwise member 18 is sized to be received by an inner perimeter of the second lengthwise member receiver 32. The second transfer bar receiver 34 is attached to a closed end of the rail bracket 30.

The adjustment member 14 includes a plurality of holes 38 formed through a length thereof. A width hole 40 is formed through the other end of the lengthwise member 12. One end of the adjustment bar 14 is inserted into the other end of the lengthwise member 12 and secured thereto with a width fastener 42. A second width hole 44 is formed through the other end of the lengthwise member 18. The other end of the adjustment bar 14 is inserted into the other end of the second lengthwise member 18 and secured with a second width fastener 46. The adjustment member 14 preferably accommodates bed frame widths between 34 inches to 42 inches, but other dimensions may also be used.

The lengthwise members 12, 18 preferably have a centerline of one end offset from a centerline of an opposing end by a distance "O," so that the transfer bar device 1 will fit multiple bed types. Satisfactory results have been found with a dimension "O" of 1.5 inches, but other dimensions could also be used. A threaded insert 48 is retained in the one end of the lengthwise members 12, 18. The lengthwise members 12, 18; the adjustment member 14 and the lengthwise member receivers 24, 32 preferably have a rectangular cross section to prevent rotation of the lengthwise members 12, 18 relative to the rail attachment members 10, 16, but other non-rotational cross sections may also be used.

Figure 4:
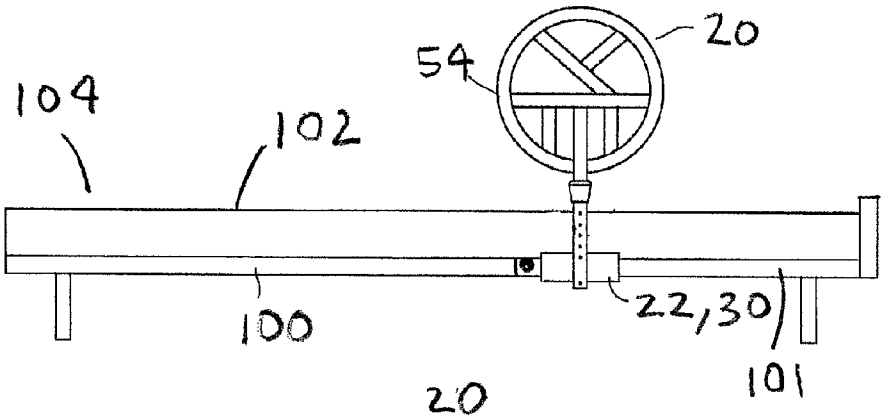
FIG. 4 is an end view of a transfer bar device attached to a bed frame in accordance with the present invention.
Figure 5:
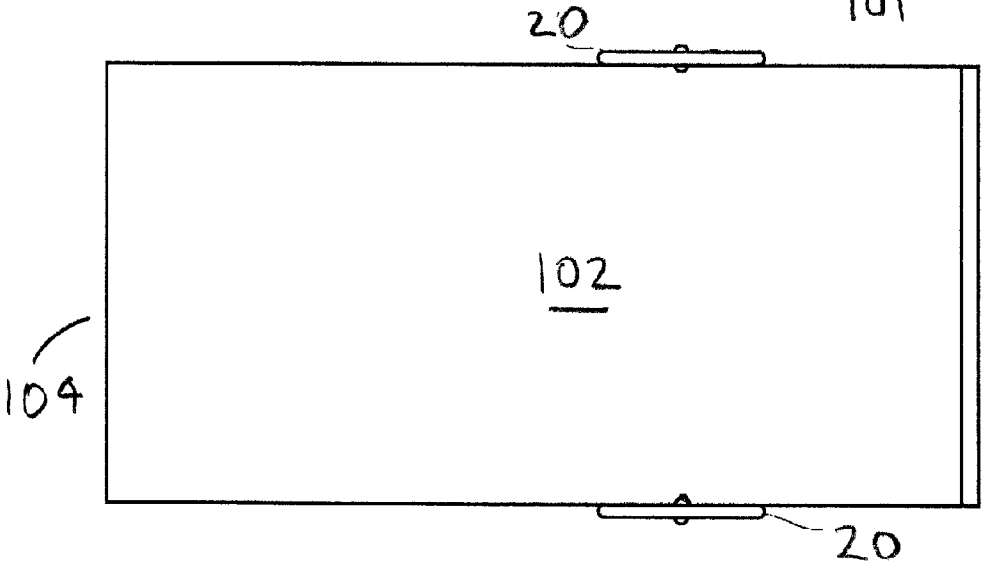
FIG. 5 is a top view of a transfer bar device attached to a bed frame with two transfer bars in accordance with the present invention.

A fastener washer 50 is located on one end of the lengthwise member receivers 24, 32. An adjustment fastener 52 is inserted through the fastener washer 50 and threaded into the threaded insert 48 in the lengthwise members 12, 18. Tightening the adjustable fasteners 52 will secure the rail brackets 22, 30 on the deck portion 101. A bottom of a mattress 102 is retained on a top of the rail brackets 22, 30. FIG. 4 shows a side view of a bed 104 with the transfer bar device 1 attached to the deck portion 101 thereof. FIG. 5 shows a top view of the bed 104 with the transfer bar device 1 attached thereto.

Figure 6:
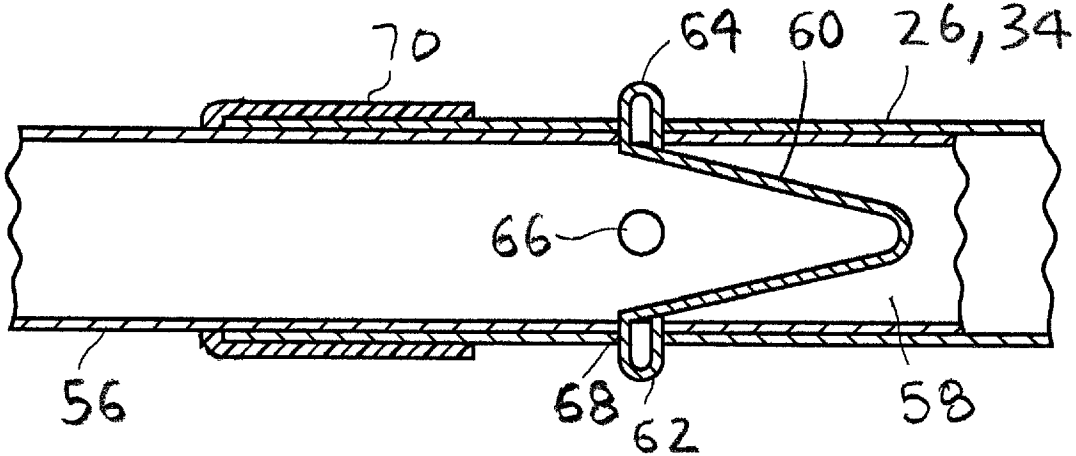
FIG. 6 is a cross-sectional view of a support post retained inside a transfer bar receiver illustrating a pair of spring pins of a transfer bar device in accordance with the present invention.

Each transfer bar 20 preferably includes a hand ring 54 and a support post 56 extending downward from the hand ring 54. The support post 56 is sized to be received by the transfer bar receivers 26, 34. With reference to FIG. 6, a spring pin insert 58 preferably includes a spring loaded body 60, a first spring pin 62 and a second spring pin 64. The spring loaded body 60 is biased, such that force must be applied to push the first and second spring pins toward each other. Retention holes 66 and exit holes 68 are formed through the transfer bar receiver 26, 34 to receive the first and second spring pins. One design of spring pin insert 58 is shown, but other designs may also be used. The retention holes 66 orient the hand ring 54, such that the hand ring 54 is parallel with a side of the bed 104. The exit holes 68 orient the hand ring 54, such that the hand ring 54 is substantially perpendicular to the side of the bed 104. A second transfer bar receiver 34 may be attached to the second rail attachment member 16 to retain a second transfer bar 20. A protective boot 70 is preferably retained on an end of the transfer bar receivers 26, 34 for safety purposes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A bed frame attachable transfer bar, comprising:

a first rail attachment member includes a first rail bracket and a first lengthwise member receiver, said first rail bracket is a first U-channel, said first lengthwise member receiver is attached to a bottom of said first rail bracket;

a first lengthwise member having one end retained by said first lengthwise member receiver;

a second attachment member includes a second rail bracket and a second lengthwise member receiver, said second rail bracket is a second U-channel, said second lengthwise member receiver is attached to a bottom of said second rail bracket;

a second lengthwise member having one end retained by said second lengthwise member receiver;

an adjustment member having one end adjustably retained by said first lengthwise member and the other end adjustably retained by said second lengthwise member; and at least one transfer bar being retained on at least one of said first and second attachment members.

2. The bed frame attachable transfer bar of claim 1, further comprising:

a transfer bar receiver is attached to at least one of said first and second rail attachment members to retain one of said at least one transfer bar.

3. The bed frame attachable transfer bar of claim 1, further comprising:

a first resilient spacer is attached to an inside surface of said first rail bracket, a second resilient spacer is attached to an inside surface of said second rail bracket.

4. The bed frame attachable transfer bar of claim 1 wherein:

a cross section of said lengthwise members, said adjustable member and said lengthwise member receivers is rectangular.

5. The bed frame attachable transfer bar of claim 1 wherein:

said adjustment member having a plurality of holes, said first lengthwise member being secured to one end of said adjustment member with a first fastener, said second lengthwise member being secured to an opposing end of said adjustment member with a second fastener.

6. The bed frame attachable transfer bar of claim 1 wherein:

a height of each one of said at least one transfer bar is adjustable relative to said rail attachment members.

7. A bed frame attachable transfer bar, comprising:

a first rail attachment member includes a first rail bracket and a first lengthwise member receiver;

a first lengthwise member having one end retained by said first lengthwise member receiver;

a second attachment member includes a second rail bracket and a second lengthwise member receiver;

a second lengthwise member having one end retained by said second lengthwise member receiver;

a threaded insert is retained in at least one of said first and second lengthwise members, a threaded fastener being threaded into said threaded insert to reduce a distance between said first and second attachment members;

an adjustment member having one end adjustably retained by said first lengthwise member and the other end adjustably retained by said second lengthwise member; and at least one transfer bar being retained by at least one of said first and second attachment members.

8. The bed frame attachable transfer bar of claim 7, further comprising:

a transfer bar receiver is attached to at least one of said first and second rail attachment members.

9. The bed frame attachable transfer bar of claim 7 wherein:

said first rail bracket is a U-channel, said first lengthwise member receiver is attached to a bottom of said first rail bracket, said second rail bracket is a U-channel, said second lengthwise member receiver is attached to a bottom of said second rail bracket.

10. The bed frame attachable transfer bar of claim 9, further comprising:

a first resilient spacer is attached to an inside surface of said first rail bracket, a second resilient spacer is attached to an inside surface of said second rail bracket.

11. The bed frame attachable transfer bar of claim 7 wherein:

a cross section of said lengthwise members, said adjustable member and said lengthwise member receivers is rectangular.

12. The bed frame attachable transfer bar of claim 7 wherein:

said adjustment member having a plurality of holes, said first lengthwise member being secured to one end of said adjustment member with a first fastener, said second lengthwise member being secured to an opposing end of said adjustment member with a second fastener.

13. The bed frame attachable transfer bar of claim 7 wherein:

a height of each one of said at least one transfer bar is adjustable relative to said rail attachment members.

14. A bed frame attachable transfer bar, comprising:

a first rail attachment member includes a first rail bracket and a first lengthwise member receiver;

a first lengthwise member having one end retained by said first lengthwise member receiver, said one end of said first lengthwise member is offset from an opposing end thereof;

a second attachment member includes a second rail bracket and a second lengthwise member receiver;

a second lengthwise member having one end retained by said second lengthwise member receiver, said one end of said second lengthwise member is offset from an opposing end thereof;

an adjustment member having one end adjustably retained by said first lengthwise member and the other end adjustably retained by said second lengthwise member; and at least one transfer bar being retained by at least one of said first and second attachment members.

15. The bed frame attachable transfer bar of claim 14, further comprising:

a transfer bar receiver is attached to at least one of said first and second rail attachment members.

16. The bed frame attachable transfer bar of claim 14 wherein:

said first rail bracket is a U-channel, said first lengthwise member receiver is attached to a bottom of said first rail bracket, said second rail bracket is a U-channel, said second lengthwise member receiver is attached to a bottom of said second rail bracket.

17. The bed frame attachable transfer bar of claim 16, further comprising:

a first resilient spacer is attached to an inside surface of said first rail bracket, a second resilient spacer is attached to an inside surface of said second rail bracket.

18. The bed frame attachable transfer bar of claim 14 wherein:

a cross section of said lengthwise members, said adjustable member and said lengthwise member receivers is rectangular.

19. The bed frame attachable transfer bar of claim 14 wherein:

said adjustment member having a plurality of holes, said first lengthwise member being secured to one end of said adjustment member with a first fastener, said second lengthwise member being secured to an opposing end of said adjustment member with a second fastener.

* * * * *